US006764040B2

(12) United States Patent
Kiyota

(10) Patent No.: US 6,764,040 B2
(45) Date of Patent: Jul. 20, 2004

(54) METHOD FOR CONTROLLING A DEVICE FOR CONTINUOUSLY SUPPLYING WEB AND DEVICE THEREFOR

(75) Inventor: Hirotaka Kiyota, Chiba (JP)

(73) Assignee: Komori Corporation, Tokyo (JP)

( * ) Notice: Subject to any disclaimer, the term of this patent is extended or adjusted under 35 U.S.C. 154(b) by 19 days.

(21) Appl. No.: 10/120,550

(22) Filed: Apr. 12, 2002

(65) Prior Publication Data

US 2002/0148923 A1 Oct. 17, 2002

(30) Foreign Application Priority Data

Apr. 13, 2001 (JP) ..... 2001-114860

(51) Int. Cl.[7] ..... B65H 19/18

(52) U.S. Cl. ..... 242/554; 242/554.2; 242/554.3; 242/554.4; 242/555.5

(58) Field of Search ..... 242/554, 554.2–554.4, 242/555.5–555.6

(56) References Cited

U.S. PATENT DOCUMENTS 3,253,795 A 5/1966 Penrod et al.
3,738,587 A * 6/1973 Christiani ..... 242/554.2
3,886,031 A * 5/1975 Taitel ..... 156/504
3,907,235 A * 9/1975 Gaubert ..... 242/554
3,948,715 A * 4/1976 Tokuno ..... 156/351
3,977,618 A * 8/1976 Kato et al. ..... 242/554
4,010,061 A * 3/1977 Tokuno ..... 156/504
4,165,842 A * 8/1979 Mengel ..... 242/554.2
4,190,483 A * 2/1980 Ryan et al. ..... 156/504
4,238,261 A * 12/1980 Tetro ..... 156/157
4,519,858 A * 5/1985 Martin ..... 156/64
4,543,152 A * 9/1985 Nozaka ..... 156/502
4,652,329 A * 3/1987 Focke ..... 156/351
5,083,718 A * 1/1992 Chen ..... 242/554.3
5,152,472 A 10/1992 Spang et al.

* cited by examiner

*Primary Examiner*—Kathy Matecki
*Assistant Examiner*—Sang K Kim
(74) *Attorney, Agent, or Firm*—Birch, Stewart, Kolasch & Birch, LLP

(57) ABSTRACT

In the case where the width of a web roll for the next job is much different from that of the web roll for the former job, the rotational position of the new web roll is moved to a position at which a web of the new roll is easily pasted to the web of the old roll and the new web roll is held at the position. A device for continuously supplying a web can continuously supply the web by adhering the web of an old web roll onto the web of the new web roll. The device includes a manual paper paster setting means for setting a manual paper paster mode and a control device for locating/stopping the rotational position of the new web roll at an adhering waiting position in response to a signal from the manual paper paster setting means.

9 Claims, 5 Drawing Sheets

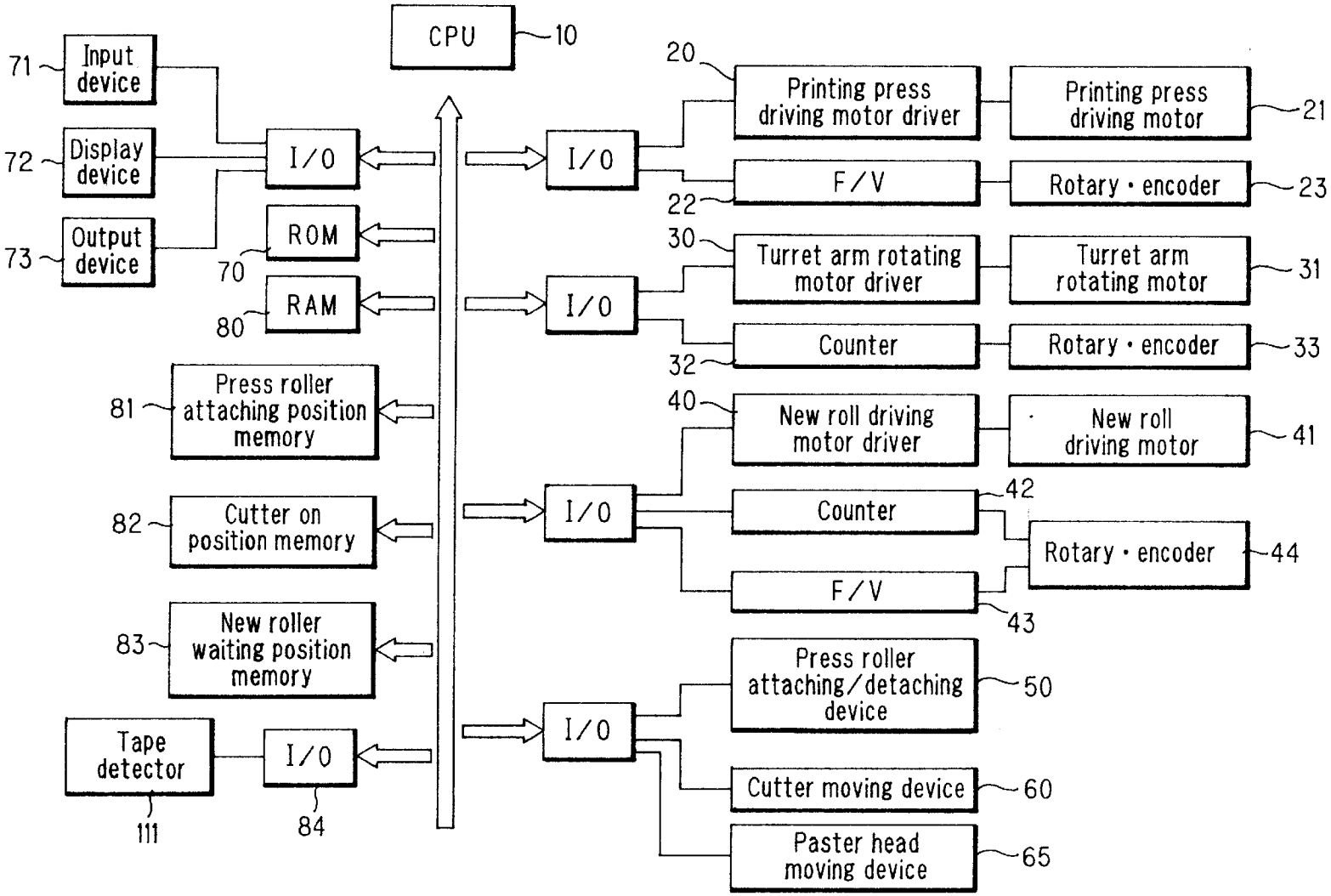
FIG. 3
CPU
10
I/O
20
Printing press driving motor driver
21
Printing press driving motor
F/V
22
Rotary · encoder
23
I/O
30
Turret arm rotating motor driver
31
Turret arm rotating motor
Counter
32
Rotary · encoder
33
I/O
40
New roll driving motor driver
41
New roll driving motor
Counter
42
F/V
43
Rotary · encoder
44
I/O
Press roller attaching/detaching device
50
Cutter moving device
60
Paster head moving device
65
I/O
ROM
70
RAM
80
Press roller attaching position memory
81
Cutter on position memory
82
New roller waiting position memory
83
I/O
84
Tape detector
111
Input device
71
Display device
72
Output device
73

METHOD FOR CONTROLLING A DEVICE FOR CONTINUOUSLY SUPPLYING WEB AND DEVICE THEREFOR

The entire disclosure of Japanese Patent Application No.2001-114860 filed on Apr. 13, 2001 including specification, claims, drawings and summary is incorporated herein by reference in its entirety.

BACKGROUND OF THE INVENTION

1. Field of the Invention

The present invention relates to a method for controlling a device for continuously supplying a web member and a device therefor.

2. Prior Art

In a conventional web rotary printing machine, when a former job is shifted to a new job, a web paster is operated automatically if the width of a new web roll is the same as that of a former web roll.

On the other hand, if the width of a new web roll is much narrower than that of the former web roll, problems are apt to occur. Therefore, considerable time and manual effort by the operator are needed to switch the former job to the next job.

A purpose of the present invention is to provide a method for controlling a device for continuously supplying a web so as to resolve the above drawbacks and a device therefor by moving the rotational position of a new web roll into a position where the new web roll is preferably paper-pasted and kept in a good condition if the width of the web for the new job is much narrower than that for the former job.

SUMMARY OF THE INVENTION

In a control method according to the present invention for controlling a device for continuously supplying a web by adhering the web of an old web roll to the web of the new web roll, a first aspect of the present invention is a step of locating the rotational position of the new web roll at an adhering waiting position in response to a signal from a manual paper pasting setting means for setting a manual paper pasting mode according to the present invention.

A second aspect of the control method according to the present invention is a step of switching on the manual paper pasting setting means under a condition in which an automatic paper pasting operation is likely to cause problems such as in the case where the width of the web of the new roll is much narrower/wider than the width of the web of the old roll or in the case where the material of the web of the new roll is different from the material of the web of the old roll.

A third aspect of the control method according to the present invention is a step for reducing the rotational speed of the printing press in response to the signal from the manual paper pasting setting means.

A fourth aspect of the control method according to the present invention is a step of adhering the web of the old web roll onto the web of the new web roll in response to a signal from a switch for adhering the web of the old web roll onto the web of the new web roll.

A fifth aspect of the control method according to the present invention is a step for cutting the web being unwound from the old web roll in response to a signal from a switch for cutting the web being unwound from the old web roll.

Regarding a control device of the present invention for controlling a device for continuously supplying a web by adhering the web of an old web roll onto the web of a new web roll, a feature of the control device according to the present invention is a means for setting a manual paper pasting mode and a control device for stopping the rotational position of the new web roll at an adhering waiting position in response to a signal from the means for setting a manual paper pasting mode.

Regarding the control device according to the present invention, another feature of the present invention is the provision of a switch means for adhering the web of the old web roll onto the web of the new web roll and means for adhering the web of the old web roll onto the web of the new web roll.

Regarding the control device according to the present invention, another feature of the present invention is the provision of a switch means for cutting the web being unwound from the old web roll in response to a signal from the switch.

BRIEF DESCRIPTION OF THE DRAWINGS

FIG. 3 shows a block diaphragm of a control for the embodiment of the device for continuously supplying a web to an offset rotary printing press according to the present invention.

DETAILED DESCRIPTION OF THE PREFERRED EMBODIMENTS

Figure 1:
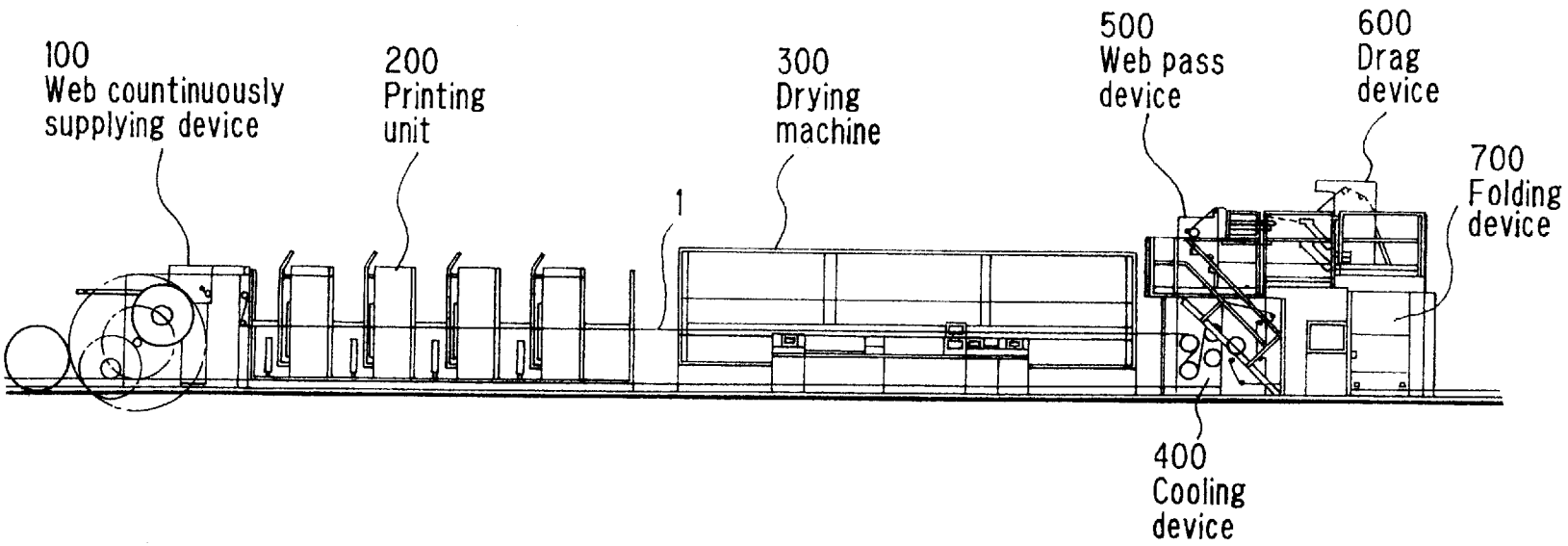
FIG. 1 shows a schematic side view of an offset rotary printing press, wherein the present invention is applied.
Figure 2:
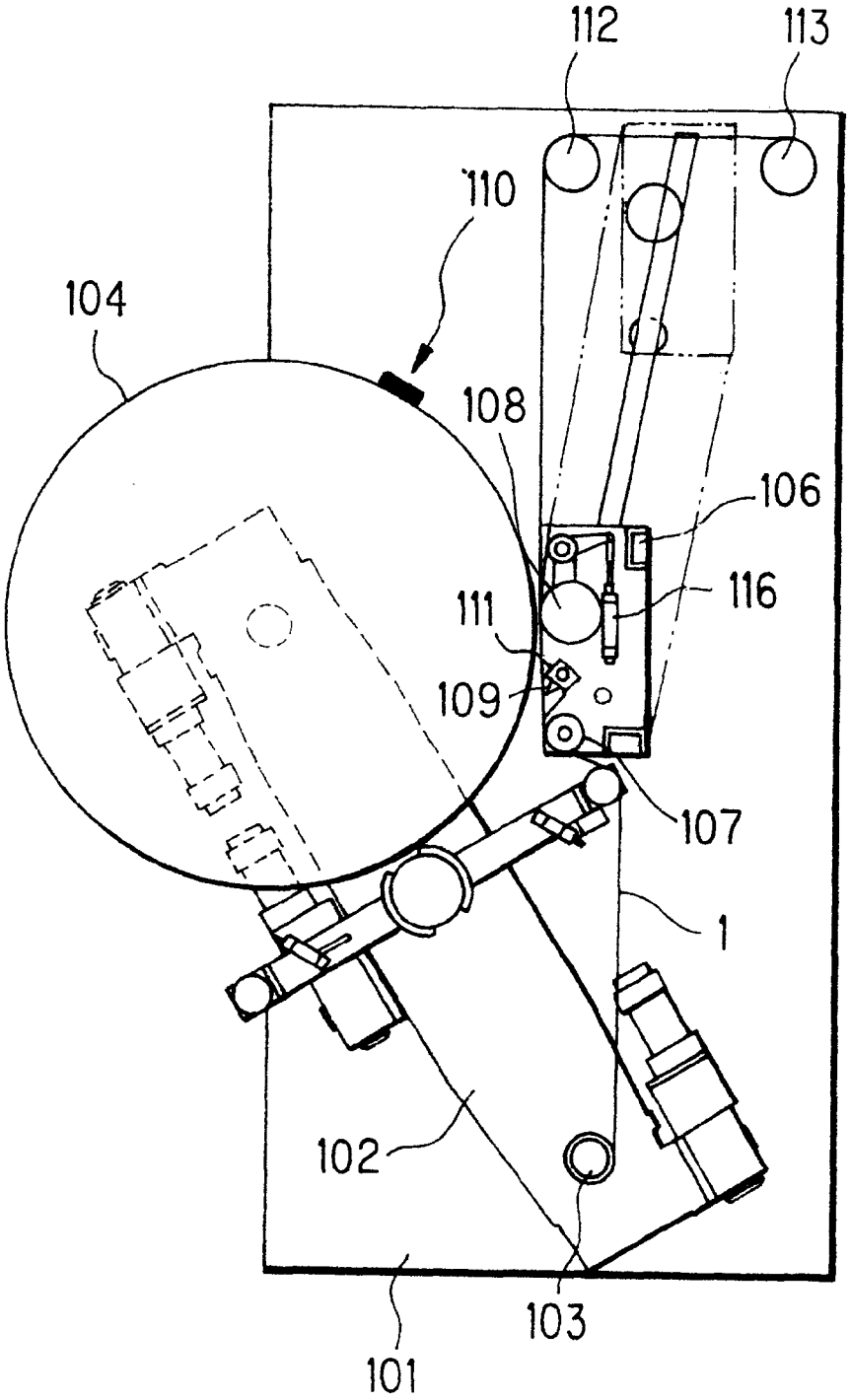
FIG. 2 shows one embodiment of a device for continuously supplying a web to an offset rotary printing press according to the present invention.

A control method for continuously supplying a web to an offset rotary printing press according to one embodiment of the present invention and a device therefor are shown in FIGS. 1 through 3.

The embodiment is suitable for an offset rotary printing machine as shown in FIG. 1.

A web member 1, continuously supplied from a continuously supplying web device 100 (hereinafter, it is referred as "web 1") is individually printed in each printing unit 200 through which the web 1 is passed. Then, the web 1 is heated and dried in a drying machine 300. The web 1 is cooled in a cooling machine 400. When the web 1 is being passed through a web passing device 500, the tension applied to the web 1 and the travel direction of the web 1 are controlled. After passing through a dragging device 600, the web 1 is cut and folded by a folding machine 700 so as to be formed into a desired shape.

FIG. 3 shows a control device for continuously controlling the devices 200 through 700.

In the controlling device, an input device 71, a display device 72 and an output device 73 are each connected to a CPU 10 through an I/O device, respectively. A ROM 70, a RAM 80, a memory 81 for an adapted position of a press roller and a memory 82 for cutter position of the press roller and a memory 83 for a waiting position of a new roller are each connected to the CPU 10, respectively. A detector 111 for detecting a double sided tape is connected to the CPU 10 through an I/O device 84.

Figure 4:
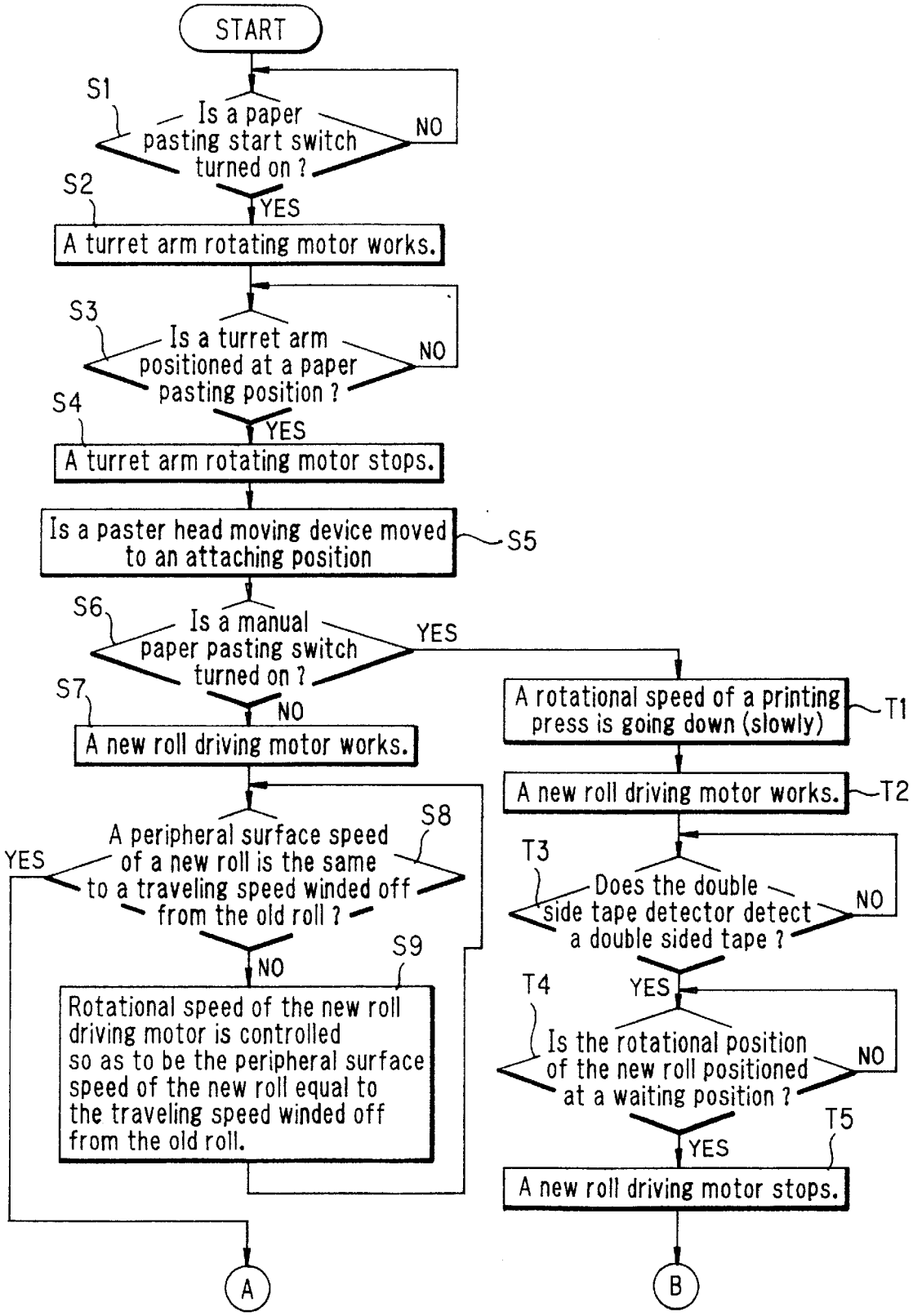
FIG. 4 and FIG. 5 are flowcharts for showing the steps of the method of the present invention for switching an automatic paper pasting mode and a manual paper pasting mode in a method for continuously supplying a web to an offset rotary printing press.
Figure 5:
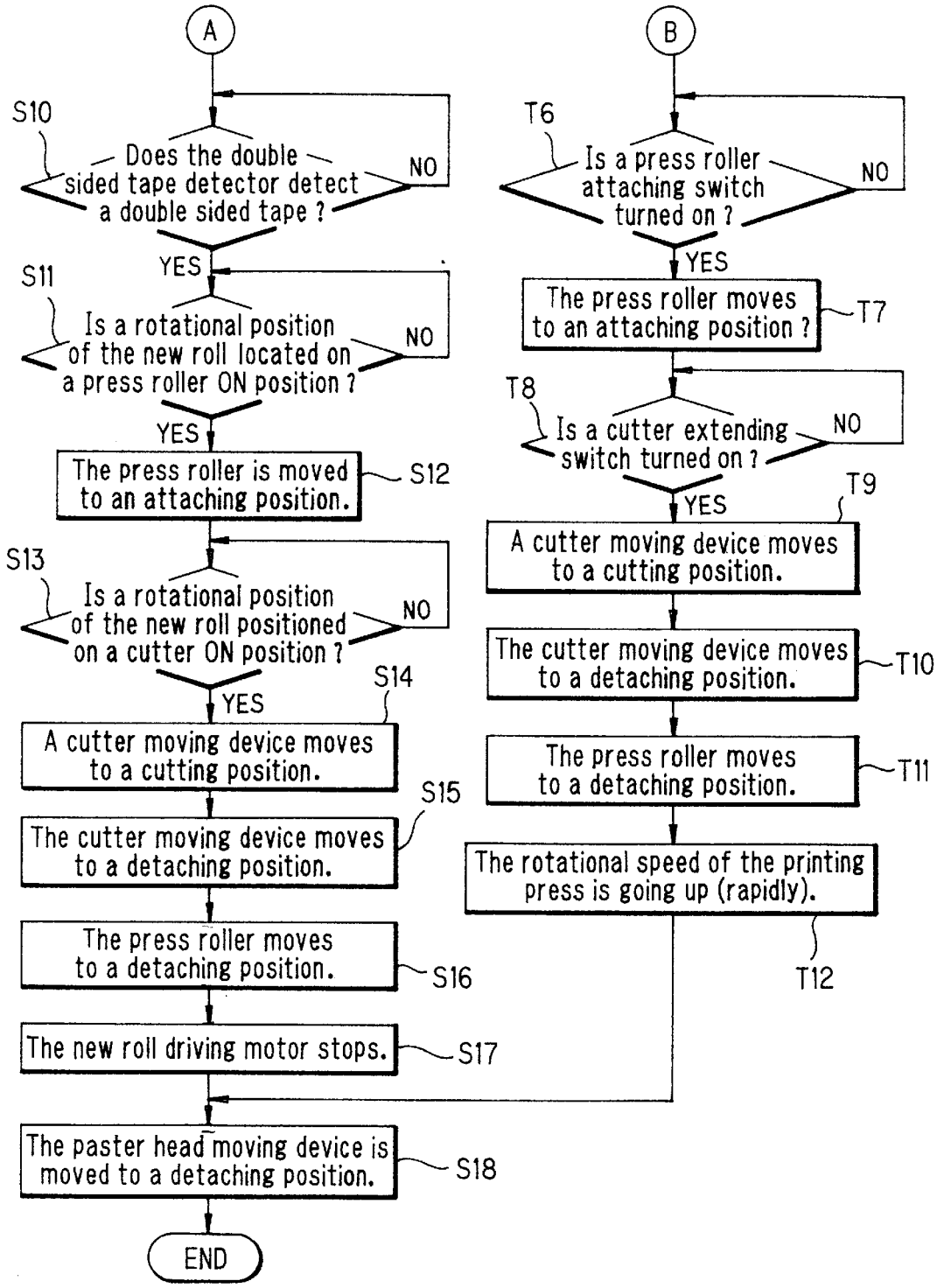

With reference to the flow charts described below and as shown in FIG. 4 and FIG. 5, the control device controls a printing press motor driver 20, a printing machine driving motor 21, a Frequency-Voltage Converter 22, a rotary encoder 23, a turret arm rotating motor driver 30, a turret arm driving motor 31, a counter 32, a rotary encoder 33, a new roll motor driver 40, a new roll driving motor 41, a counter 42, a Frequency-Voltage Converter 43, a rotary encoder 44, a press roller attaching/detaching device 50, a cutter moving device 60 and a paster head moving device 65.

Regarding the control device, the present specification mainly describes the switching operation of an automatic web pasting and a manual web pasting in the device for continuously supplying a web 100. The description about the other conventional control operations is omitted.

In the device for continuously supplying a web 100 as shown in FIG. 2, a turret arm 102 is pivotally provided at a body 101. Web rolls 103 and 104 are attached to the opposite ends of the turret arm 102, respectively. When a web 1 is almost finished being wound off from the web roll 103, another web 1 from the web roll 104 is pasted to the web 1 from web roll 103 so as to pass a web through the printing unit 200 continuously.

FIG. 2 shows a condition in which the old web roll (hereinafter, it is referred as "old roll") 103 is almost finished and a new web roll (hereinafter, it is referred as "new roll") 104 is moved to a paper pasting position by rotating the turret arm 102.

The turret arm 102 is rotated by the turret arm rotating motor 31 in accordance with an ON signal from a paper pasting start switch (not shown) through the turret arm rotating motor driver 30 as shown in FIG. 3.

The rotational angle of the turret arm 102 is detected by the rotary encoder 33 and is totally counted by the counter 32.

In the turret arm 102, a pre-driving device for rotating the rolls 103 and 104 is installed. The pre-driving device previously accelerates a surface speed of the new roll 104 which has been moved to the paper pasting position to the traveling speed of the web 1.

In FIG. 3, the new roll driving motor 41 is provided as a pre-driving device for driving the new roll 104 and controlled through the new roll driving motor driver 40.

The rotational speed of the new roll 104 is detected as a voltage value through the Frequency-Voltage Converter 43 by the rotary encoder 44.

In the body 101, the paster head 106 is movably provided along an oblique direction in the drawing of FIG. 2. The paster head 106 can be obliquely moved from a detached position as shown as by dotted lines in FIG. 2 to an attached position as shown in solid lines in FIG. 2 with respect to the new roll 104 which has been moved to the paper paster position.

When the paster head 106 is moved to the attached position, the web being unwound from the old roll 103 is fed through a gap between the new roll 104 and the paster head 106 and over a plurality of rollers 112 and 113.

In the paster head 106, a fixed roller 107 and a press roller 108 are provided. The press roller 108 can be protruded from an air cylinder 116 so as to be actuated as a press roller attaching device 50. Further, a cutter 109 is attached to the paster head 106. The cutter 109 is extendable from a cutter moving device 60, such as an air cylinder.

In the paster head 106, a double sided tape detector 111 is provided for detecting a double sided tape 110, attached at the front end of the new web 104.

In the device for continuously supplying a web 100, there may be some problems when the device 100 is operated in an automatic paper paster mode if the width of the web 1 of the old roll 103 is much narrower than that of the web 1 of the new roll 104. Even if the width of the web of the new roll 104 and that of the old roll 103 are the same, there may still be some problems if the material of the new roll 104 is different from that of the old roll 103.

In the present invention, a manual paper paster starter switch is provided as means for setting a manual paper paster operation. In response to an ON signal from the manual paper paster starter switch, the control device described above is operated in accordance with the flow chart as shown in FIG. 4 and FIG. 5 so as to stop the rotating position of the new roll 104 at an adhering waiting position.

As shown in FIG. 4, the paper paster start switch is first turned on (step S1). A turret arm rotating motor is rotated so as to rotate the turret arm 102 (step S2).

Then, the new roll 104 held by the turret arm 102 is moved to a paper pasting position (step S3). The turret arm rotating motor then is stopped (step S4).

The rotational angle of the turret arm 102 is detected by the rotary encoder 33 and is totally counted by the counter 32. Next, the paster head moving device 65 is actuated so as to move the paster head 106 to an attaching position (step S5).

When the manual paper paster start switch is not turned on, that is, when it is turned off (step S6), the new roll driving motor 41 is rotated if the width of the web 1 of the old roll 103 is substantially the same as that of the new roll 104 (step S7).

When the peripheral surface speed of the new roll 104 is not equal to the traveling speed of a web 1 being unwound from the old roll 103 (step S8), the rotational speed of the new roll driving motor 41 controls the rotational speed of the new roll 104 so as to adjust the peripheral surface speed of the new roll 104 to be equal to the traveling speed of the web 1 being unwound from the old roll 103 (step S9).

The double sided tape detector 111 detects a double sided tape 110 (step S10). When the rotational position of the new roll 104 is located at an ON position of the press roller 108 as stored in the press roller attaching position memory 81 (step S11), the press roller attaching/detaching device 50 is moved to its attaching position so as to move the press roller 108 to its attaching position (step S12) where the web 1 of the old roll 103 is adhered on a web 1 of the new roll 104 with the double sided tape 110.

When the rotational position of the new roll 104 is located at an ON position of the cutter 109 as stored in the cutter ON position memory 82 (step S13), the cutter moving device 60 is moved to its cutting position so as to move the cutter 109 to its cutting position (step S14), where the web 1 from the old roll 103 is cut and the old roll 103 is moved to a detaching position (step S15).

When the press roller attaching/detaching device 50 is moved to its detaching position (step S16), the new roll driving motor 41 is stopped (step S17) and the paster head 106 is moved to its detaching position (step S18).

On the other hand, when the manual paper paster start switch is turned on, the rotational speed of the printing press is slowed (step T1) and the new roll driving motor 41 is rotated (step T2) unless it is a preferable condition for paper-pasting the old roll 103 and the new roll 104.

The rotational speed of the printing press is checked by detecting the rotational speed of the printing press driving motor 21 by the rotary encoder 23.

Then, the double sided detector 111 detects the double sided tape 110 (step T3). When the rotational position of the new roll 104 is located at a waiting position of the new roll 104 as stored in the new roll waiting position memory 83 (step T4), the new roll driving motor 41 is stopped (step T5).

When the press roller attaching switch is turned on (step T5), the press roller attaching/detaching device 50 is moved to its attaching position (step T7).

The press roller attaching switch is actuated for adhering a web 1 of the old roll 103 on a web 1 of the new roll 104. In response to a signal from the press roller attaching switch, the press roller attaching/detaching device 50 is moved to its attaching position so that the web 1 being unwound from the old roll 103 can be pressed onto a peripheral surface of the new roll 104 by the press roller 109. Thereby, the new roll 104 is also rotated and the web 1 of the old roll 103 is adhered to the web 1 of the new roll 104 via the double sided tape 110.

When a cutter extending switch is turned on (step T8), the cutter 109 is moved to its cutting position by the cutter moving device 60 (step T9) and then moved to its detaching position (step T10).

The cutter extending switch is actuated so as to cut the web 1 which is being unwound from the old roll 103. In response to a signal from the cutter extending switch, the web 1 being unwound from the old roll 103 is cut by the cutter 109.

In the next step, the press roller attaching/detaching device 50 is moved to its detaching position (step T11), the rotational speed of the printing press is increased to normal and the paper paster is moved to the exterior of the body 101 (step T12).

As described above, in the embodiment according to the present invention, if the width of the web 1 of the old roll 103 is substantially the same as that of the web 1 of the new roll 104 and the manual paper paster start switch is turned off, the web 1 of the old roll 103 can be continuously pasted onto the web 1 of the new roll 104 similar to a conventional device for continuously supplying a web.

Further, in the embodiment according to the present invention, if the width of the web 1 of the old roll 103 is much narrower than that of the web 1 of the new roll 104 and the manual paper paster start switch is turned on, the rotational position of the new roll 104 can be positioned at the adhering waiting position so that problems with the paper pasting operation can be avoided.

After positioning the rotational position of the new roll 104 at the adhering waiting position, a paper pasting operation can be continued by turning on the press roller attaching switch and the cutter extending switch.

When the press roller adhering switch is turned on, the web 1 of the old roll 103 is adhered to the web 1 of the new roll 104 by moving the press roller attaching/detaching device 50 to its attaching position so that the web 1 being unwound from the old roll 103 can be cut by turning on the cutter extending switch.

Although an operator manually moves the rotational position of the new roll to a paper pasting position in the conventional art, such a manual operation is unnecessary in the embodiment according to the present invention.

In the specification, a manual paper pasting is different from that conducted in the conventional art. The manual paper pasting of the present invention means turning on a manual paper paster start switch so as to locate the rotational position of the new roll 104 at its adhering waiting position. After that, the paper pasting operation is automatically operated.

In the present invention, when the paper pasting operation is manually operated, the rotational speed of the printing machine is slowed. Under this condition, problems can be prevented from occurring during the paper pasting operation.

As described above, in the embodiment according to the present invention, if a width of a web of a new roll is much different from that of an old roll, an automatic paper pasting is not preferable. Under the condition wherein some problems are apt to occur during the paper pasting operation, the rotational position of the new web roll is moved to a paper pasting position by actuating an automatic paper pasting setting means.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A method for controlling a device for continuously supplying a web by adhering a web of an old web roll onto a web of a new web roll, said method comprising:

moving said new web roll into proximity with said web of the old web roll; and controlling the rotational position of said new web roll about its axis said new web roll such that the leading edge of said new web roll is at an adhering waiting position in response to a signal from a manual paper pasting setting means for setting a manual paper pasting mode.

2. A method for controlling a device for continuously supplying a web as claimed in claim 1, said method further comprising:

switching on said manual paper pasting setting means under a condition in which an automatic paper pasting operation is likely to cause problems, including when the width of said web of said new web roll is narrower/wider than the width of said web of said old web roll.

3. A method for controlling a device for continuously supplying a web as claimed in claim 1, said method further comprising:

adhering the web of said old web roll onto the web of said new web roll in response to a signal from a switch for adhering the web of said old web roll onto the web of said new web roll.

4. A method for controlling a device for continuously supplying a web as claimed in claim 3, said method further comprising:

cutting the web being unwound from said old web roll in response to a signal from a switch for cutting the web being unwound from said old web roll.

5. A method for controlling a device for continuously supplying a web as claimed in claim 1, said method further comprising:

switching on said manual paper pasting setting means under a condition in which an automatic paper pasting operation is likely to cause problems, including when a material of said web of said new web roll is different from a material of said web of said old web roll.

6. A device for controlling a device for continuously supplying a web by adhering a web of an old web roll onto a web of a new web roll, said device comprising:

a first driving means for moving said new web roll into proximity with said web of the old web roll;

a second driving means for controlling the rotational position of said new web roll about its axis such;

means for setting a manual paper pasting mode; and a control device for stopping said second driving means at a rotational position of said new web roll such that the leading edge of said new web roll is at an adhering waiting position in response to a signal from said means for setting a manual paper pasting mode.

7. A device for controlling a device for continuously supplying a web as claimed in claim 6, said device further comprising:

a switch for adhering the web of said old web roll onto the web of said new web roll; and means for adhering the web of said old web roll onto the web of said new web roll in response to a signal from said switch.

8. A control device for controlling a device for continuously supplying a web as claimed in claim 7, said control device further comprising:

a switch for cutting the web being unwound from said old web roll; and means for cutting the web being unwound from said old web roll in response to a signal from said switch.

9. A method for controlling a device for continuously supplying a web as claimed in one of claim 1, claim 2 and claim 5, said method further comprising:

reducing the rotational speed of a printing press in response to said signal from said manual paper pasting setting means.

* * * * *